US006818278B1

(12) United States Patent
Blythe

(10) Patent No.: US 6,818,278 B1
(45) Date of Patent: Nov. 16, 2004

(54) CONSTRUCTION MATERIALS

(75) Inventor: Robert John Blythe, Birmingham (GB)

(73) Assignee: Sovereign Rubber Limited, Cheshire (GB)

( * ) Notice: Subject to any disclaimer, the term of this patent is extended or adjusted under 35 U.S.C. 154(b) by 0 days.

(21) Appl. No.: 09/485,034

(22) PCT Filed: May 26, 1999

(86) PCT No.: PCT/GB99/01456

§ 371 (c)(1),
(2), (4) Date: Feb. 2, 2000

(87) PCT Pub. No.: WO99/63162

PCT Pub. Date: Dec. 9, 1999

(30) Foreign Application Priority Data

Jun. 3, 1998 (GB) ..... 9811809

(51) Int. Cl.[7] ..... B32B 3/00; D06N 7/04

(52) U.S. Cl. ..... 428/143; 428/58; 428/141; 428/331

(58) Field of Search ..... 428/58, 141, 143, 428/331

(56) References Cited

U.S. PATENT DOCUMENTS

| | | | | | |
|---|---|---|---|---|---|
| 3,801,421 | A | * | 4/1974 | Allen et al. | 428/17 |
| 3,916,969 | A | * | 11/1975 | Auerbach et al. | 152/532 |
| 4,201,261 | A | * | 5/1980 | Bartley et al. | 152/209.1 |
| 4,337,292 | A | * | 6/1982 | Biotteau | 428/141 |
| 4,474,833 | A | * | 10/1984 | Maxfield | 427/138 |
| 4,529,622 | A | * | 7/1985 | Maxfield | 427/136 |
| 4,564,310 | A | | 1/1986 | Thelen et al. | 404/31 |
| 4,822,026 | A | * | 4/1989 | Schobermayr et al. | 472/92 |
| 5,088,724 | A | * | 2/1992 | Hawkins et al. | 472/92 |
| 5,514,722 | A | * | 5/1996 | Di Geronimo | 521/42 |
| 5,605,721 | A | * | 2/1997 | Di Geronimo | 427/373 |
| 6,036,998 | A | * | 3/2000 | Calvo et al. | 427/214 |

FOREIGN PATENT DOCUMENTS

| | | | |
|---|---|---|---|
| AT | 318453 | | 10/1974 |
| EP | 0 088 748 | | 9/1983 |
| EP | 0 165 895 | | 12/1985 |
| EP | 0 216 344 | | 4/1987 |
| EP | 0 514 363 | | 11/1992 |
| FR | 2696485 | | 4/1984 |
| GB | 2023624 | | 1/1980 |
| JP | 54-48927 | * | 4/1979 |
| JP | 5-4048927 | | 4/1979 |
| SU | 718463 | | 2/1980 |
| WO | WO 9219669 | | 11/1992 |
| WO | WO 9723551 | | 7/1997 |

OTHER PUBLICATIONS

The American Heritage Dictionary, 2ed., Houghton Mifflin Co., 1982, pp. 86–87.*

* cited by examiner

*Primary Examiner*—Cynthia Kelly
*Assistant Examiner*—Jill M. Gray
(74) *Attorney, Agent, or Firm*—Fay, Sharpe, Fagan, Minnich & McKee, LLP

(57) ABSTRACT

Construction materials suitable for use as, or in, a wearing course for children's play areas, games areas and like purposes, comprise an agglomerate of granules of a thermoplastic elastomer. The granules of the agglomerate are conveniently held together by means of a polyurethane or other binding agent or by being melded together. The thermoplastic elastomer is, for example, a block copolymer of the styrene type, for example a styrene-butadiene-styrene block copolymer. The granules of the thermoplastic elastomer are preferably angular granules or multi-facet granules.

29 Claims, No Drawings

CONSTRUCTION MATERIALS

This invention relates to construction materials suitable for use as, or in, a wearing course, for example for children's play areas, athletics and other games, and horse riding. It also relates to methods of making the construction materials and to polymers in particular granulated or other comminuted form for use in said materials.

During recent years there has been adopted, as the wearing course of running racks and similar surfaces on which games are played, a polymeric material in compounded form known as EPDM. "EPDM" refers to terpolymers obtained by the copolymerisation of ethylene and propylene with a small proportion of a diene monomer to permit conventional sulphur vulcanisation at sites of olefinic unsaturation. Subsequently, similar wearing courses have been used as impact-absorbent means in locations where safety is a prime requirement, for example children's play areas; commonly with a bulk (base) layer of recycled rubber granules.

However, in spite of its widespread use, these EPDM materials suffer from several disadvantages of which the major ones are as follows:

(a) Due to pressure from the sports/safety surface construction industry to reduce the cost of EPDM the formulation has been cheapened, using less polymer than originally formulated and now often relies on off-specification polymer, that is polymer of an inferior grade, to further reduce costs. This insistence of the users effectively controls the expansion of the application of sports and safety surfaces because there is insufficient off-specification EPDM available.

(b) Owing to stringent laws in USA, of-specification EPDM material cannot be used in that country.

(c) The dilution of the formulation and the use of off-specification polymer has reduced the quality of surfaces obtained using EPDM compared to the original concept.

(d) Off-specification EPDM is typically brown in colour instead of water white. The resultant compound requires the use of high levels of titanium dioxide to mask the brown background colour and/or uses high pigment concentrations. The consequence is that the product is expensive due to the large amount of pigment required to mask the brown colour.

(e) The granulation of the compounded EPDM produces high dust content (ca.20%) which has to be removed from the granules. There is a small outlet use for dust (0–0.5 mm and 0.5–1.5 mm) in texture sprays and recycling into virgin EPDM compounds. However, the disposal of dust is often expensive and reduces the cost effectiveness of the product.

(f) With regard to the important use in playground safety surfaces, British Standard BS 7188: 1989 specifies an abrasion test which, at present, materials based on current EPDM granules bound with current moisture-curing polyurethane frequently fail to meet. This prevents many safety surface constructors using coloured EPDM when their customers require full compliance with British Standard BS 5696: 1986.

It has now been found, according to the present invention, that excellent construction materials for use in the preparation of wearing courses can be obtained by using as their polymer component (or, at least one of their polymer components) a thermoplastic elastomer (also referred to below as "TPE"), thereby avoiding, or at least mitigating to a substantial extent, the disadvantages of the EPDM-based materials referred to above.

Accordingly, in a first aspect the present invention provides a construction material for use as, or in, a wearing course, which comprises an agglomerate of granules of a thermoplastic elastomer.

By way of example, the thermoplastic elastomer can be a copolymer, for instance a block copolymer of the styrene type. Suitable examples of the latter are one or more of:

styrene-butadiene-styrene (SBS) block copolymers, styrene-isoprene-styrene (SIS) block copolymers and styrene-ethylene-butadiene-styrene (SEBS) block copolymers.

Thermoplastic elastomers have, in general, a molecular weight in the range 50,000 to 500,000. They can be conventionally compounded but do not require a cross-linking system. Where, for example, the thermoplastic elastomer is an SBS block copolymer, when heated the blocks of polymer take up a random distribution allowing shaping and forming. On cooling, it is believed that the polystyrene blocks form domains joined by polybutadiene bridges. This mechanism produces a balance of stiffness and elasticity similar to cross-linking. On re-heating the domains disappear and the thermoplastic elastomer reverts to being thermoplastic.

Examples of thermoplastic elastomers suitable for use in the present invention are ones sold under the Trade Marks Calprene, Finaprene, and/or Europrene Sol.

The thermoplastic elastomer is normally used in a compounded form. Suitable compounds, given by way of example, are ones containing one or more of fillers, processing oils, processing aids, antioxidants and pigments.

The thermoplastic elastomer used should, in general, have a softening temperature to suit the ambient conditions in which the construction material of the invention is to be used.

In general the thermoplastic elastomer is one containing a white or coloured pigment with a view to effecting a desirable appearance in the laid wearing course though, if appropriate, the elastomer can be used without added pigment.

The granules of the agglomerate can be of any suitable shape and size. In general the size, and especially the shape, are dictated by the properties required from the wearing course, and especially in the amount of any binder used in producing the agglomerate. Thus, on the one hand, it is in general preferred to avoid using granules of spherical or spheroidal shape as such shapes do not result in good binding contact between adjacent granules. On the other hand, if the granules have too great a surface area it can result in an excess amount of binder being required. It is preferred that the granules be angular granules, that is, granules having at least one edge in their periphery. In particular, the granules can be multi-facet granules, especially granules having up to eight facets, especially five, six or seven facets. With a view to avoiding the requirement of an excess amount of binder (where used), it is preferred that the granules have smooth surfaces.

With regard to size of the granules, it is normally convenient for them to be of a size in the range from 0.5 mm to 10 mm, that is, all of the granules will pass a 10 mm mesh but all will be retained by a 0.5 mm mesh. A preferred size is in the range from 1 mm to 4 mm.

The TPE granules can be formed into an agglomerate using a liquid or other binder, for example a polyurethane binder. The binder, whether polyurethane or otherwise, can be used in any suitable amount, the amount being usually a balance between, on the one hand, achieving satisfactory agglomeration between the granules and, on the other hand, economy in the amount of binder used. Suitable amounts of binder, especially where a polyurethane binder is used, are in the range from 5 to 30 parts by weight, that is, 5 to 30 parts by weight of the binder per 100 parts by weight of the elastomer (or compounded elastomer), and especially 10, 15, 20, 25 or other amount in the range from 10 to 25 parts by weight of the binder.

As an alternative to the use of a binder—or even as an auxiliary to the use of a binder—the agglomerate can be formed by melding the granules, that is by melting or softening their surfaces to such an extent that they will bond together, if necessary, under the influence of applied external pressure. Where melding is used it can be, for example, effected by the use of infra red radiation, hot air, microwave radiation or by the use of a hot platen. Where a hot platen is used it is usually to provide a pre-fabricated wearing course sheet or other member for subsequent laying. By use of a hot platen there can be obtained pre-fabricated members having either a smooth, impervious surface or a textured surface, for example one having appropriate drainage channels or other three-dimensional effect.

In a second aspect the present invention provides angular or multi-facet granules of a thermoplastic elastomer suitable for use in the construction material of the first aspect of the invention.

In a third aspect, the present invention provides a composition suitable for preparation of the construction material of the first aspect of the invention, the composition comprising:

(a) a first component comprising a granular thermoplastic elastomer; and
(b) a second component comprising a binding agent for the granules.

The thermoplastic elastomer granules can be mixed with the binder to produce the blended composition of the invention by conventional means used for mixing granules of EPDM with binder. The resulting blended product can be laid as a wearing course by conventional means, for example by a wet-pour technique and, if appropriate, surface pressing.

The advantages of the construction materials of this invention (at least in their preferred forms) compared with the EPDM materials can be summarised as follows:

1. They fully meet BS 5696 (see Tables below)
2. Bright colours can be obtained at no extra cost.
3. Improved efficiency of use (see Tables below)
4. Resistance to high concentrations of UV light and ozone (see Tables)
5. Use of on-specification polymer
6. Dust produced in the granulation process is recyclable into its own colour formation.
7. Constructions using thermoplastic elastomer exclusively are recyclable.

EXAMPLES

Preferred embodiments of the several aspects of the present invention are illustrated by the following Examples.

Example 1

This Example describes the preparation of a blue pigmented granular TPE of the invention, the TPE being a styrene-butadiene-styrene (SBS) block copolymer.

A sheet of compounded pigmented styrene-butadiene-styrene-copolymer sold under the Trade Mark TPR 99 (ex Manchester Rubber) was granulated using an Alpine High-speed machine to produce a granular product.

The granular product was then subjected to the action of a cyclone to remove dust and leave a product consisting substantially of 100% angular granules (as herein defined). The size distribution of the granules, compared with a typical EPDM product, is given below:

| | TPE (%) | EPDM (%) |
|---|---|---|
| Passing 4.0 mm | 99.0 | 99.8 |
| Passing 2.8 mm | 55.5 | 74.8 |
| Passing 2.0 mm | 12.8 | 34.0 |
| Passing 1.0 mm | 0.8 | 6.5 |

Example 2

This Example describes the preparation of a thermoplastic composition for laying as a wearing course.

The pigmented granular material obtained as product of Example 1 was blended with a liquid polyurethane binder sold by Stockmeier under the Trade Name STOBIELAST S133, the polyurethane binder being used in an amount of 15 parts per 100 parts of the granular material (by weight). The blending was carried out in a Crete angle pan mixer.

The resulting product was an easily worked, evenly coated admixture of rubber and binder.

Comparative Example A

For the purpose of comparison, Example 1 was repeated but using, instead of the styrene-butadiene-styrene block copolymer, an EPDM material of the kind used for the preparation of conventional wearing courses. The resulting product also has a particle size such that all of it would pass through a 4 mm mesh and a small amount passing through a 1 mm mesh.

Comparative Example B

For the purpose of comparison, Example 2 was repeated but using, instead of the product of Example 1, the product of Comparative Example A, and the polyurethane binder was used in an amount of 17.5 parts per 100 parts of EPDM (by weight)

Example 3

This Example describes the use of the blended product of Example 2 as a wearing course.

Into a flat mould 7 cm deep and of lateral dimensions 1 meter×1 meter was spread a support or bulk layer 5 cm deep of a support material comprising a blend of:

(a) rubber granules of sizes in the range 2 mm to 6 mm and
(b) a liquid polyurethane binder, the binder being in an amount of 8 parts per 100 parts of rubber (by weight) The rubber granules had been obtained by granulating rubber of scrap truck tyres.

24 hours after laying the support layer there was spread on its upper surface a 2 cm wearing layer of the blended product of Example 2 above, the support layer being consolidated by pressure applied using a straight edge trowel.

Comparative Example C

Example 3 was repeated but using the blended product of Comparative Example B instead of the blended product of Example 2.

The products of Example 3 and Comparative Example C were tested according to BS 7188: 1989 (Methods of test for impact-absorbing playground surfaces), and the Ease of Ignition test was made according to BS 4790: 1987. The requirements of BS 5696: 1986 are shown in a separate column.

The results obtained are shown below. It will be seen that in almost every test the product based on TPE was substantially better than that based on EPDM.

TESTING IMPACT ABSORBING PLAYGROUND SAFETY SURFACES ACCORDING TO BS 7188:1989

| | TPE | EPDM | BS 5696:1986 Specification |
|---|---|---|---|
| Critical fall height (m) | 1.66 | 1.67 | N/A |
| Resistance to Abrasive wear weight loss (g) unaged | | | |
| 1000 cycles (A) | 0.82 | 1.26 | |
| 2000 cycles | 0.70 | 0.98 | |
| 3000 cycles | 0.71 | 1.00 | |
| 4000 cycles | 0.57 | 0.87 | |
| 5000 cycles (B) | 0.64 | 0.86 | |
| Wear Index (a/1000 cycles) | 0.82 | 1.26 | <1.00 |
| Wear Ratio (A/B) | 1.28 | 1.46 | 1.0–3.0 |
| Aged Wear Heat | | | |
| Wear Index (g/1000) | 0.57 | 0.98 | <1.00 |
| Wear Radio (A/B) | 1.33 | 1.36 | 1.0–3.0 |
| Water | | | |
| Wear Index (g/1000) | 0.72 | 1.04 | <1.00 |
| Wear Ratio (A/B) | 1.31 | 1.55 | 1.0–3.0 |
| Xenon | | | |
| Wear Index (g/1000) | 0.56 | 1.07 | <1.00 |
| Wear Ratio (A/B) | 1.17 | 1.85 | 1.0–3.0 |
| Slip Resistance | | | |
| Dry | 92 | 89 | >40 |
| Wet | 50 | 44 | >40 |
| Ease of Ignition | | | |
| Time to flame extinction (secs) | Did not ignite | 18 | |
| Time to smoke extinction (secs) | 300 | 42 | |
| Maximum Radius of damage (mm) | 16.5 | 14 | <35* |
| Resistance to Indentation | | | |
| load on (90 sec) mm | 3.5 | 25.2 | |
| Load on (15 min) mm | 8.8 | 29.7 | Resist. Puncture |
| Load Off (90 sec) mm | 8.0 | 5.8 | |
| Load off (15 min) mm | 8.0 | 3.7 | |
| Load off (150 min) mm | 7.7 | 3.0 | |
| Load off (22 hrs) mm | 6.5 | 2.8 | |
| Covering rate Kg/m$^2$ | 18.7 | 23.8 | |

*according to BS 4790

BS 7188: 1989 Methods of test for impact absorbing playground surfaces.

BS 5696: 1986 Playground equipment intended for permanent installations outdoors BS 4790: 1987 Method for determination of the effects on a small source of ignition on textile floor coverings (hot metal nut method)

Example 4

Example 2 was repeated but using 20 parts (instead of 15 parts) of the polyurethane binder per 100 parts of the granular material (by weight).

Comparative Example D

Comparative Example B was repeated but using 20 parts (instead of 15 parts) of the polyurethane binder per 100 parts of the granular material (by weight).

Example 5

This Example describes the use of the blended product of Example 4 as a wearing surface of an impact-absorbent structure.

Into a flat mould 2 cm deep and of lateral dimensions 0.1 meter×0.1 meter was spread a 2 cm wearing layer of the blended product of Example 2 above, the wearing layer being consolidated by pressure applied using a straight edge trowel. No bulk (support) layer was used.

Comparative Example E

Example 5 was repeated but using the blended product of Comparative Example D instead of the blended product of Example 2. The polyurethane binder was used in an amount of 20 parts per 100 parts of EPDM (by weight).

Accelerated Atmospheric Exposure

The products of Example 5 and Comparative Example E were subjected to an accelerated ageing test on an "EMMAQUA Fresnel reflecting concentrator" at DSET Laboratories, Phoenix, Ariz., USA. The results obtained were as follows, the heading "TPE" indicating the product of Example 4 and "EPDM" the product of Comparative Example D.

| | TPE | EPDM |
|---|---|---|
| U/V Dose MJ/m$^2$ | 414 | 414 |
| Temperature at the surface (maximum) ° C. | 57 | 57 |
| Effect | No visible deterioration | Significant hardening |

NB The exposure in this test was equivalent to 36 months exposure under typical weather conditions in England.

The construction materials of the present invention can be used in a wide variety of indoor and outdoor applications. They can, for example, be used by laying at the location where they are to be used, for example by a wet-pour technique, or they can be pre-formed, for example as tiles, blocks, sheets or other structural elements, for subsequent placement.

Preferred compounded thermoplastic elastomer materials used for making granular materials of the present invention have one or more of the following physical properties (measured according to BS 903):

| | |
|---|---|
| Tensile Strength (MPa>) - greater than 2.0, for example | 5.5 |
| Elongation at break (%) - greater than 200, for example | 785.0 |
| Hardness IRHD - in the range 30–90, for example | 76.0 |
| Tear resistance kN/m - about | 10.0 |
| Abrasion loss mm$^3$ (DIN53516) - less than 450, for example | 360.0 |
| Ageing 168 hours at 70° (change) % | |
| Hardness | 0 |
| Tensile strength | 0 |
| Elongation at break | 0 |
| Specific gravity g/m$^3$ about | 1.25 |

What is claimed is:

1. A construction material for use as, or in, a wearing course, which comprises an agglomerate of granules of a thermoplastic elastomer, wherein the granules are agglomerated together by means of a binder, and said thermoplastic elastomer comprises a styrene block copolymer.

2. A construction material according to claim 1, wherein the granules are angular or multi-facet granules.

3. A construction material according to claim 1, wherein the granules have smooth surfaces.

4. A construction material according to claim 1, wherein the granules are substantially free from dust.

5. A construction material according to claim 1, wherein substantially all of the granules are in the size range of 0.5 mm to 10 mm.

6. A construction material according to claim 5, wherein substantially all of the granules are in the size range from 1 mm to 4 mm.

7. A construction material according to claim 1, wherein the thermoplastic elastomer is a styrene block copolymer.

8. A construction material according to claim 1, wherein the thermoplastic elastomer is one or more of:

a styrene-butadiene-styrene (SBS) block co-polymer, a styrene-isoprene-styrene (SIS) block copolymer, a styrene-ethylene-butadiene-styrene (SEBS) block copolymer.

9. A construction material according to claim 1, which includes a pigment.

10. A construction material according to claim 1, wherein the binder substantially fills the interstices between the granules.

11. A granular thermoplastic elastomer suitable for use in the construction material, according to claim 1, wherein the granules of thermoplastic elastomer are angular or multi-facet granules.

12. A composition suitable for the preparation of a construction material as claimed in claim 1, the composition comprising:

(a) a first component comprising a granular thermoplastic elastomer; and (b) a second component comprising a binding agent for the granules.

13. A composition according to claim 12, wherein the binding agent is a polyurethane binder.

14. A construction material, for use as, or in, a wearing course, which comprises an agglomerate of granules of a thermoplastic elastomer, wherein the granules are agglomerated together by having been melded together, and said thermoplastic elastomer comprises a styrene block copolymer.

15. A construction material according to claim 14, wherein the granules are angular or multi-facet granules.

16. A construction material according to claim 14, wherein the granules have smooth surfaces.

17. A construction material according to claim 14, wherein the granules are substantially free from dust.

18. A construction material according to claim 14, wherein substantially all of the granules are in the size range of 0.5 mm to 10 mm.

19. A construction material according to claim 18, wherein substantially all of the granules are in the size range from 1 mm to 4 mm.

20. A construction material according to claim 14, wherein the thermoplastic elastomer is a styrene block copolymer.

21. A construction material according to claim 14, wherein the thermoplastic elastomer is one or more of:

a styrene-butadiene-styrene (SBS) block co-polymer, a styrene-isoprene-styrene (SIS) block copolymer, a styrene-ethylene-butadiene-styrene (SEBS) block copolymer.

22. A construction material according to claim 14, which includes a pigment.

23. A wearing course comprising a laid layer of a construction material comprising an agglomerate of granules of a thermoplastic elastomer, said thermoplastic elastomer comprises a styrene block copolymer, and said construction material has been compacted after laying.

24. A wearing course according to claim 23, which has a thickness in the range 2 cm to 6 cm.

25. A wearing course according to claim 23, which has been laid in direct contact with the ground.

26. A wearing course comprising a laid layer of a construction material and a bulk layer supporting the laid layer, said construction material comprises an agglomerate of granules of a thermoplastic elastomer comprising a styrene block copolymer, and said bulk layer comprises rubber granules agglomerated by means of a binder.

27. A wearing course according to claim 26, wherein said layer is supported by an underlying bulk layer.

28. A wearing course according to claim 26, wherein the bulk layer has a thickness of up to 10 cm.

29. A wearing course according to claim 28, wherein the bulk layer has a thickness in the range from 2 cm to 6 cm.

* * * * *